US011791586B2

(12) United States Patent
Chen et al.

(10) Patent No.: US 11,791,586 B2
(45) **Date of Patent: *Oct. 17, 2023**

(54) ELECTRICAL CONNECTOR IN COMPLIANCE WITH HDMI 2.1

(71) Applicant: Advanced Connectek Inc., New Taipei (TW)

(72) Inventors: Chingtien Chen, New Taipei (TW); Wei Wan, New Taipei (TW); Xiaojuan Qi, New Taipei (TW)

(73) Assignee: Advanced Connectek Inc., New Taipei (TW)

( * ) Notice: Subject to any disclaimer, the term of this patent is extended or adjusted under 35 U.S.C. 154(b) by 62 days.

This patent is subject to a terminal disclaimer.

(21) Appl. No.: 17/544,936

(22) Filed: Dec. 8, 2021

(65) Prior Publication Data

US 2022/0181817 A1 Jun. 9, 2022

(30) Foreign Application Priority Data

Dec. 8, 2020 (CN) ..... 202011425332.6

(51) Int. Cl.

| | |
|---|---|
| ***H01R 13/504*** | (2006.01) |
| ***H01R 43/02*** | (2006.01) |
| ***H01R 13/6581*** | (2011.01) |
| ***H01R 107/00*** | (2006.01) |

(52) U.S. Cl.

CPC ..... *H01R 13/504* (2013.01); *H01R 13/6581* (2013.01); *H01R 43/02* (2013.01); *H01R 2107/00* (2013.01)

(58) Field of Classification Search

None

See application file for complete search history.

(56) References Cited

U.S. PATENT DOCUMENTS

| | | | | |
|---|---|---|---|---|
| 8,251,740 | B2 * | 8/2012 | Grice | H01R 13/6471 439/490 |
| 8,287,299 | B2 * | 10/2012 | Ray | H01R 13/6273 439/353 |
| 2007/0082555 | A1 * | 4/2007 | Tanaka | H01R 31/06 439/660 |
| 2019/0020154 | A1 * | 1/2019 | Wan | H01R 12/724 |
| 2022/0181816 | A1 * | 6/2022 | Chen | H01R 13/50 |

* cited by examiner

*Primary Examiner* — Oscar C Jimenez
(74) *Attorney, Agent, or Firm* — JCIPRNET

(57) ABSTRACT

An electrical connector complied with HDMI 2.1 including an insulating body, multiple terminals, and a metallic shell enclosing portions of the insulating body and the terminals is provided. The ten terminals includes a first terminal Data2+, a third terminal Data2−, a fifth terminal Data Shield, a seventh terminal Data0+, a ninth terminal Data0−, an eleventh terminal Data3 Shield, a thirteenth terminal CEC, a fifteenth terminal SCL, a seventeenth terminal DDC/CEC Ground, and a nineteenth terminal Hot Plug Detec1 arranged in an arrangement direction in sequence. The nine terminals includes a second terminal Data2 Shield, a fourth terminal Data1+, a sixth terminal Data1−, an eighth terminal Data0 Shield, a tenth terminal Data3+, a twelfth terminal Data3−, a fourteenth terminal Utility, a sixteenth terminal SDA, and an eighteenth terminal +5V Power arranged in an arrangement direction in sequence.

30 Claims, 7 Drawing Sheets

ELECTRICAL CONNECTOR IN COMPLIANCE WITH HDMI 2.1

CROSS-REFERENCE TO RELATED APPLICATION

This application claims the priority benefit of China application no. 202011425332.6, filed on Dec. 8, 2020. The entirety of the above-mentioned patent application is hereby incorporated by reference herein and made a part of this specification.

BACKGROUND

Field of the Disclosure

This disclosure is related an electrical connector.

Description of Related Art

With the rapid development of electronic technology nowadays, the resolution of display devices is increasing and the requirements for high transmission bandwidth have led to the emergence of a high-resolution multimedia interface (HDMI), which is a fully digitized image and sound transmission interface that can simultaneously transmit uncompressed audio and video signals, and are commonly applied in the audio-visual transmission of consumer electronic products to ensure that the signal will not be attenuated during the audio-visual transmission process.

Furthermore, as high-quality images gradually become mainstream for display of film and television, the data transmission bandwidth in conventional technology might not meet the functional requirements of the future video transmission interface, and the new HDMI 2.1 specification has been formulated. The transmission bandwidth is upgraded considerably from 18 Gbps to 48 Gbps of HDMI 2.0, and supports a variety of higher dynamic image pixels and update rates. In addition, dynamic HDR and low-latency transmission technology have also been incorporated to the functional part, which is compatible with the previous HDMI 2.0 specification.

What follows is that the terminal structure required for the new specification HDMI 2.1 is more complicated, which increases the difficulty of designing the required mold, and even requires at least two sets of different molds to meet the requirements of the new specification, which has also led to an increase in manufacturing costs.

SUMMARY

This disclosure provides an electrical connector complied with HDMI 2.1 and having a simple structure that can meet the requirements for high-frequency signal transmission.

In the disclosure, an electrical connector complied with HDMI 2.1 includes an insulating body, a plurality of terminals and a metallic shell. The metallic shell covers portions of the insulating body and the terminals. The terminals includes ten terminals located on an upper row and nine terminals located on a lower row, and the terminals are alternated along the arrangement direction of the terminals. The ten terminals located on the upper row includes a first terminal Data2+, a third terminal Data2−, a fifth terminal Data Shield, a seventh terminal Data0+, a ninth terminal Data0−, an eleventh terminal Data3 Shield, a thirteenth terminal CEC, a fifteenth terminal SCL, a seventeenth terminal DDC/CEC Ground, and a nineteenth terminal Hot Plug Detec1 arranged in an arrangement direction in sequence. The nine terminals on the lower row includes a second terminal Data2 Shield, a fourth terminal Data1+, a sixth terminal Data1−, an eighth terminal Data0 Shield, a tenth terminal Data3+, a twelfth terminal Data3−, a fourteenth terminal Utility, a sixteenth terminal SDA, and an eighteenth terminal +5V Power arranged in an arrangement direction in sequence.

In the disclosure, an electrical connector complied with HDMI 2.1 includes an insulating body, a plurality of terminals and a metallic shell. The metallic shell covers portions of the insulating body and the terminals. The terminals includes ten terminals located on an upper row and nine terminals located on a lower row, and the terminals are alternated along the arrangement direction of the terminals. The ten terminals located on the upper row includes a first terminal Data2+, a third terminal Data2−, a fifth terminal Data Shield, a seventh terminal Data0+, a ninth terminal Data0−, an eleventh terminal Data3 Shield, a thirteenth terminal CEC, a fifteenth terminal SCL, a seventeenth terminal DDC/CEC Ground, and a nineteenth terminal Hot Plug Detec1 arranged in an arrangement direction in sequence. The nine terminals on the lower row includes a second terminal Data2 Shield, a fourth terminal Data1+, a sixth terminal Data1−, an eighth terminal Data0 Shield, a tenth terminal Data3+, a twelfth terminal Data3−, a fourteenth terminal Utility, a sixteenth terminal SDA, and an eighteenth terminal +5V Power arranged in an arrangement direction in sequence. The first terminal has a width of 0.46 mm to 0.51 mm, the third terminal has a width of 0.26 mm to 0.31 mm, the fourth terminal has a width of 0.25 mm to 0.30 mm, the sixth terminal has a width of 0.25 mm to 0.30 mm, the seventh terminal has a width of 0.24 mm to 0.31 mm, the ninth terminal has a width of 0.24 mm to 0.31 mm, the tenth terminal has a width of 0.26 mm to 0.30 mm, and the twelfth terminal has a width of 0.26 mm to 0.30 mm.

Based on the foregoing, an electrical connector complied with HDMI 2.1 includes an insulating body, a plurality of terminals, and a metallic shell, and the metallic shell covers portions of the insulating body and the terminals. These terminals include ten terminals located in the upper row and nine terminals located in the lower row, and have specific pin assignments along the arrangement direction. Furthermore, the widths of the above-mentioned terminals along the arrangement direction are different. Among them, the first terminal, the third terminal, the fourth terminal, the sixth terminal, the seventh terminal, the ninth terminal, the tenth terminal and the twelfth terminal have a larger width. That is, these terminals with larger widths are used to transmit data, so the requirements for high-frequency signal transmission can be met by increasing the width of the terminals.

DESCRIPTION OF EMBODIMENTS

Figure 1:
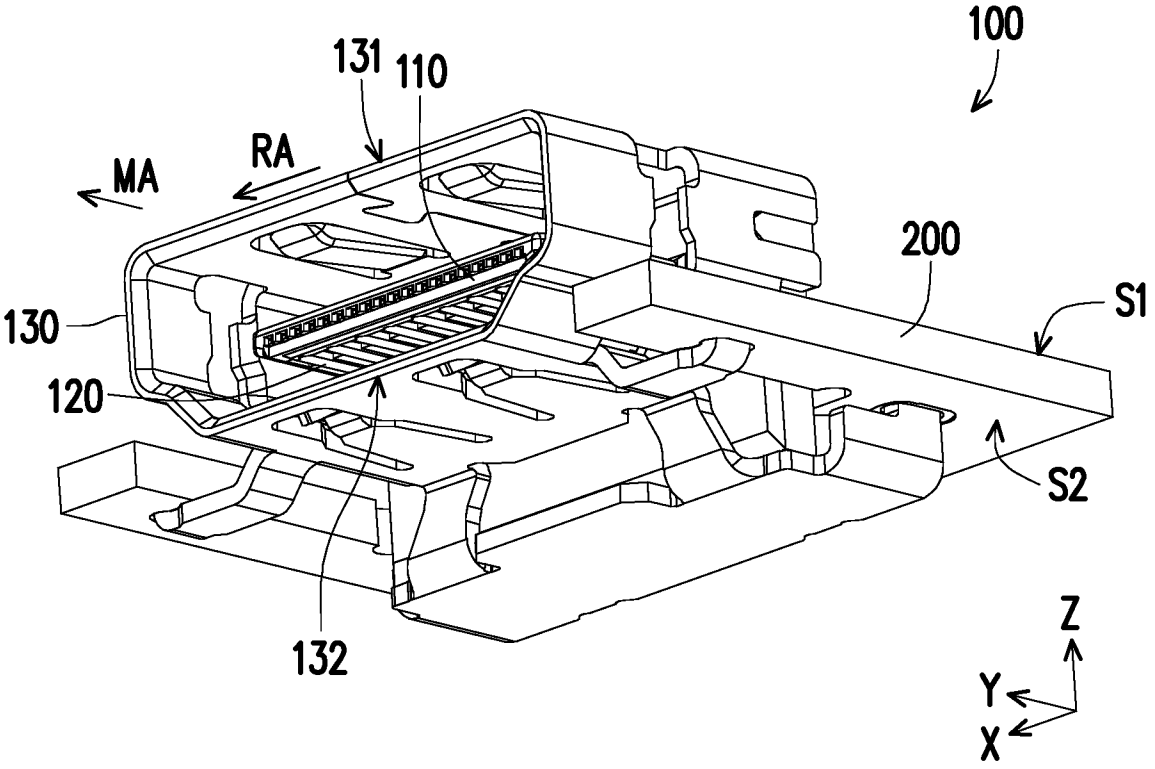
FIG. 1 is a schematic diagram of an electrical connector according to an embodiment of the disclosure.
Figure 2:
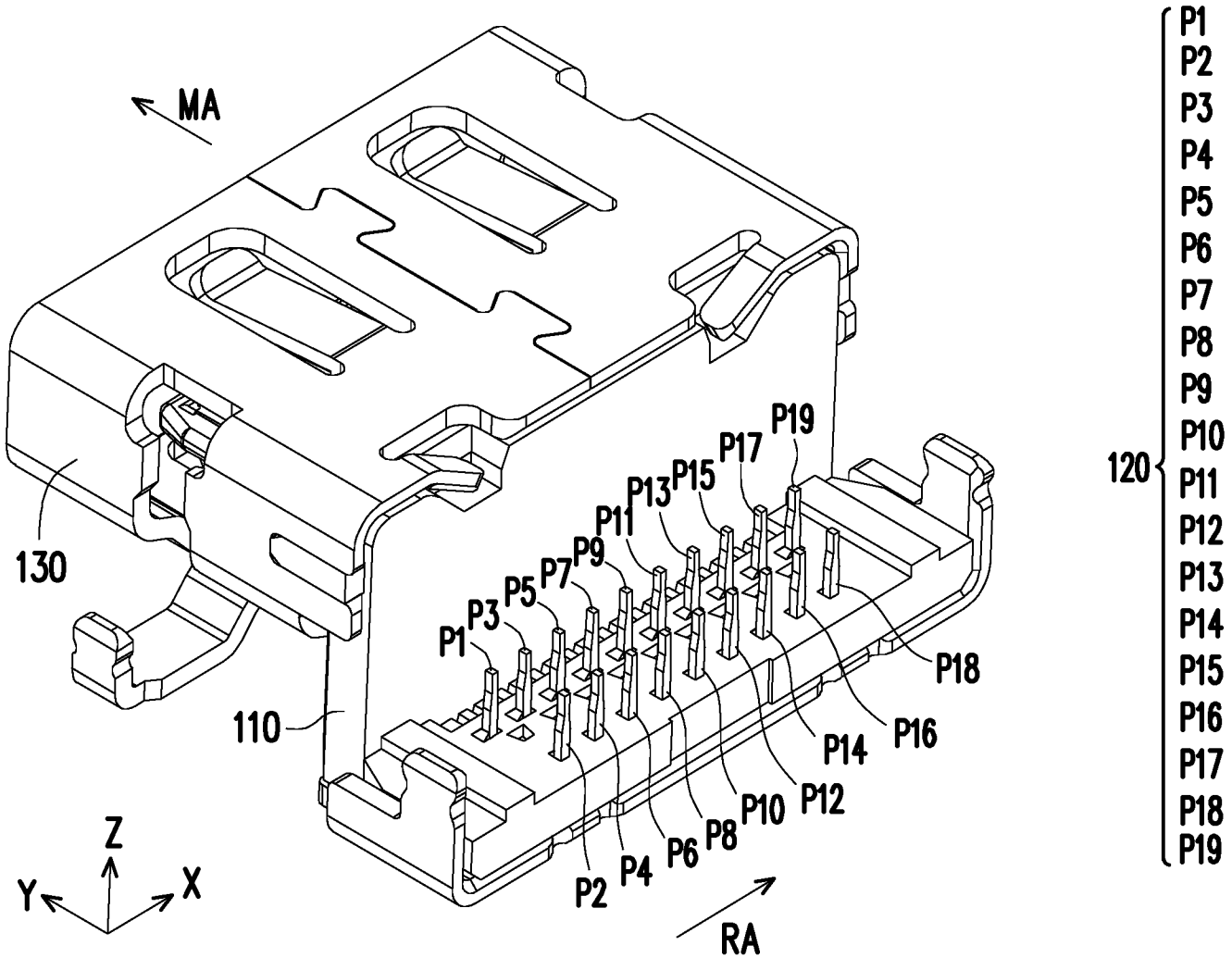
FIG. 2 and FIG. 3 are schematic diagrams of partial components of the electrical connector of FIG. 1 respectively.
Figure 3:
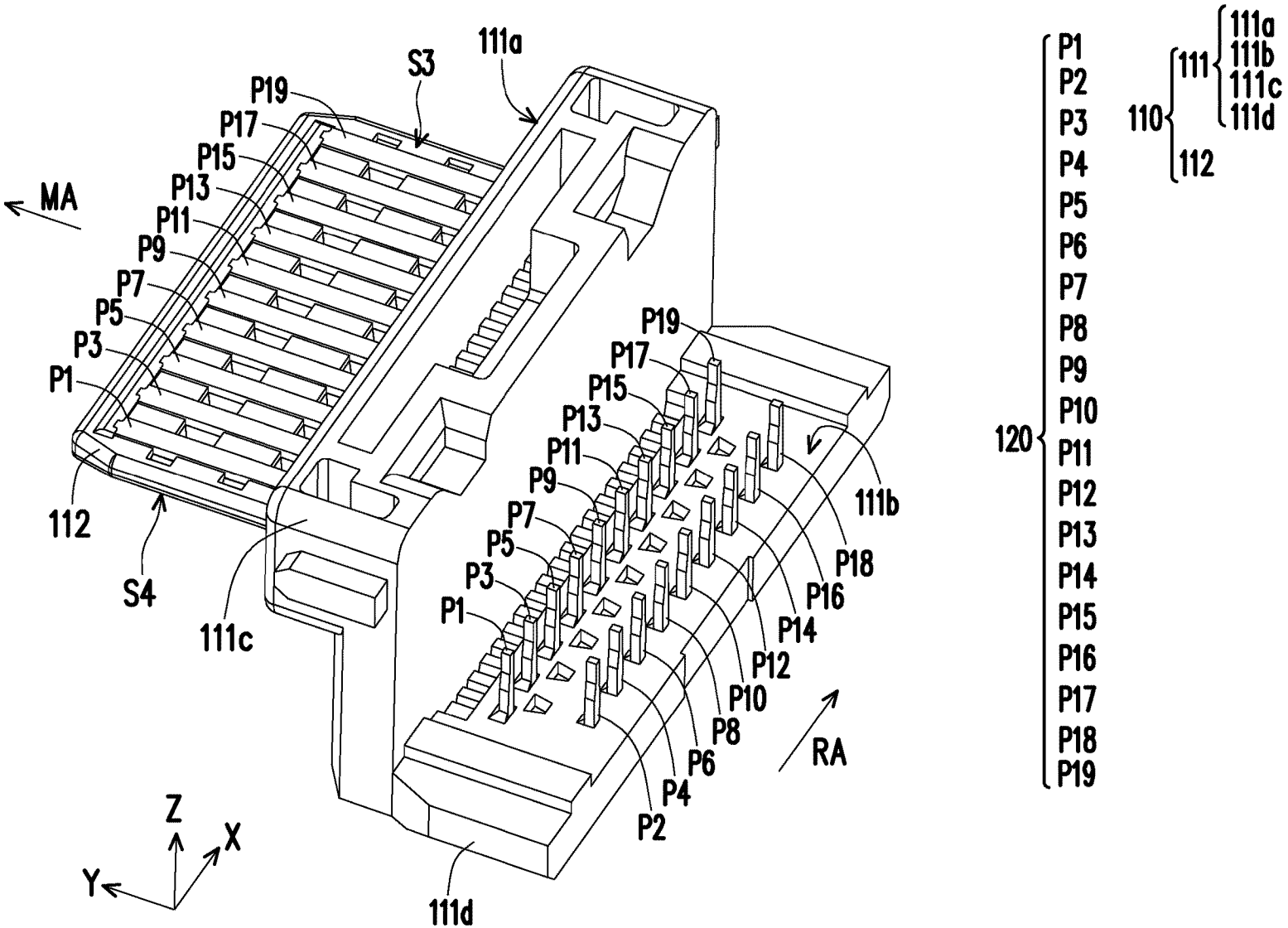

FIG. 1 is a schematic diagram of an electrical connector according to an embodiment of the disclosure. FIG. 2 and FIG. 3 are schematic diagrams of partial components of the electrical connector of FIG. 1 respectively. This embodiment further provides rectangular coordinates X-Y-Z to facilitate the subsequent description of components. Please refer to FIG. 1 to FIG. 3 at the same time. In this embodiment, the electrical connector 100 complies with HDMI 2.1, and includes an insulating body 110, a plurality of terminals 120, and a metallic shell 130. The metallic shell 130 encloses portions of the insulating body 110 and the terminals 120 to form an insertion space. Here, the electrical connector 100 is, for example, an electrical receptacle connector configured on a circuit board 200, and the circuit board 200 has an upper surface S1 and a lower surface S2 opposite to each other, and the electrical connector 100 particularly belongs to a countersunk electrical connector whose body is adjacent to the upper surface S1 and its pin inserted into the lower surface S2. In another embodiment not shown, the electrical connector 100 may also be an under-board electrical connector disposed on the lower surface S2. As shown in FIG. 2, the metallic shell 130 has pins on opposite sides along the axis X. From the perspective that the main structure of the electrical connector 100 is substantially located on the upper surface S1, the pins can be regarded as being reversely inserted on the lower surface S2 of the circuit board 200.

Figure 4:
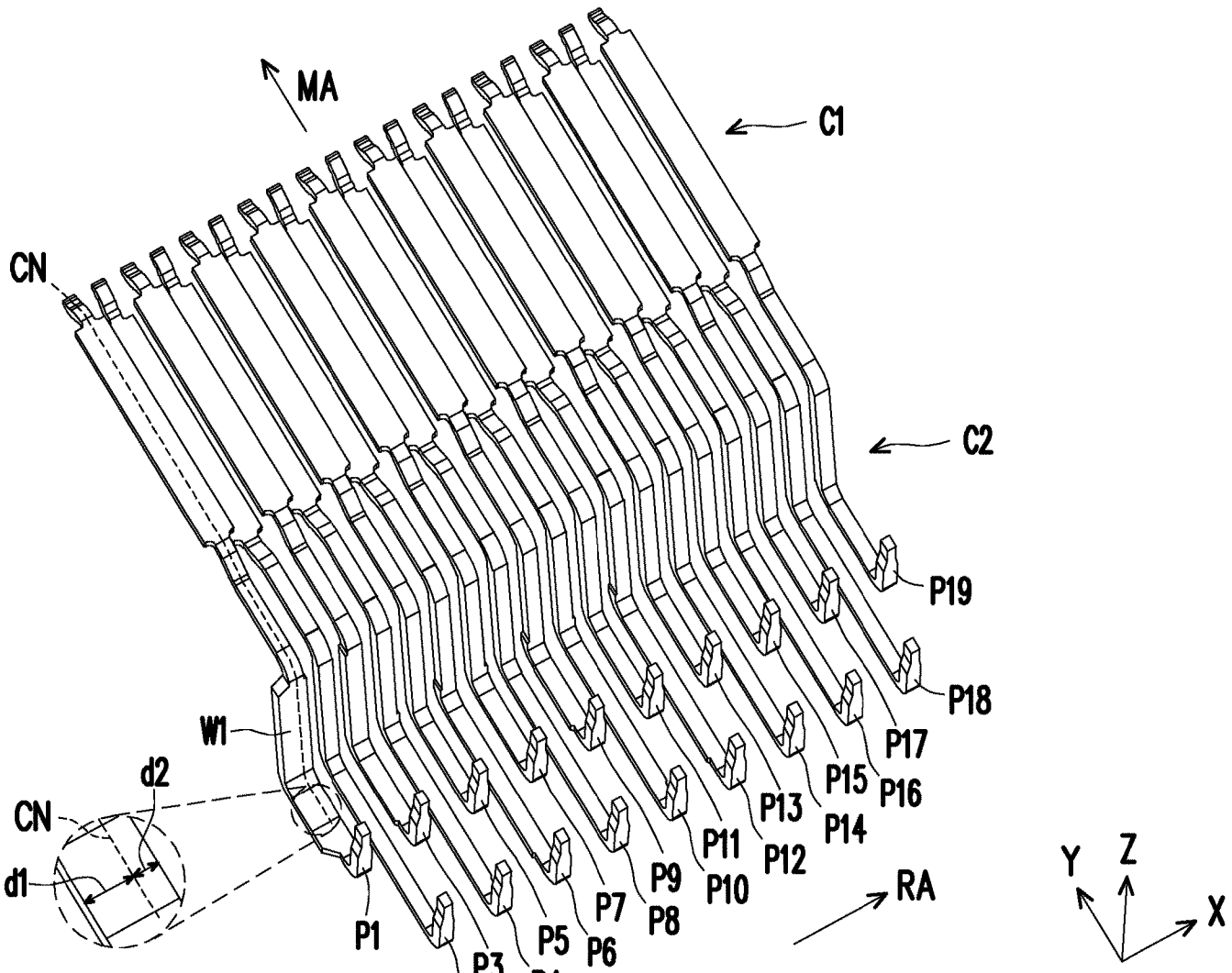
FIG. 4 is a schematic diagram of the terminals of the electrical connector of FIG. 1.

FIG. 4 is a schematic diagram of the terminals of the electrical connector of FIG. 1. Please refer to FIG. 3 and FIG. 4 at the same time. In this embodiment, the plurality of terminals 120 includes ten terminals 120 in the upper row and nine terminals 120 in the lower row, and the ten terminals 120 and the nine terminals 120 are alternated along the arrangement direction RA of the terminals 120. Here, the pin assignment of the ten terminals 120 is the first terminal P1 (Data2+), the third terminal P3 (Data2−), the fifth terminal P5 (Data Shield), the seventh terminal P7 (Data0+), the ninth terminal P9 (Data0−), the eleventh terminal P11 (Data3 Shield), the thirteenth terminal P13 (CEC), the fifteenth terminal P15 (SCL), the seventeenth terminal P17 (DDC/CEC Ground), and the nineteenth terminal P19 (Hot Plug Detec1) arranged in sequence along the arrangement direction RA. The pin assignment of the nine terminals 120 is the second terminal P2 (Data2 Shield), the fourth P4 (Data1+), the sixth terminal P6 (Data1−), the eighth terminal P8 (Data® Shield), the tenth terminal P10 (Data3+), the twelfth terminal P12 (Data3−), the fourteenth terminal P14 (Utility), the sixteenth terminal P16 (SDA), and the eighteenth terminal P18 (+5V Power) arranged in sequence along the arrangement direction RA. It should also be noted that the electrical connector 100 is adapted to be connected to another electrical connector (not shown) along an insertion direction MA. The aforementioned arrangement direction RA (towards the positive X-axial direction) and the insertion direction MA (towards the positive Y-axial direction) are orthogonal to each other. Meanwhile, as shown in FIG. 1, the metallic shell 130 has a short lateral edge 132 adjacent to the upper surface S1 and a long lateral edge 131 away from the upper surface S1. The ten terminals in the upper row are adjacent to the long lateral edge 131 and are far away from the short lateral edge 132. The nine terminals in the lower row are adjacent to the short lateral edge 132 and far away from the long lateral edge 131.

Furthermore, in order to meet the requirement of high-frequency signal transmission, the first terminal P1, the third terminal P3, the fourth terminal P4, the sixth terminal P6, the seventh terminal P7, the ninth terminal P9, the tenth terminal P10 and the twelfth terminal P12 in the embodiment are all used for data transmission, and accordingly have a larger width than the other terminals 120 to meet transmission requirements. In detail, the first terminal P1 of this embodiment has a width of 0.46 mm to 0.51 mm, the third terminal P3 has a width of 0.26 mm to 0.31 mm, the fourth terminal P4 has a width of 0.25 mm to 0.30 mm, the sixth terminal P6 has a width of 0.25 mm to 0.30 mm, the seventh terminal P7 has a width of 0.24 mm to 0.31 mm, the ninth terminal P9 has a width of 0.24 mm to 0.31 mm, the tenth terminal P10 has a width of 0.26 mm to 0.30 mm, and the twelfth terminal P12 has a width of 0.26 mm to 0.30 mm. In contrast, the width of the second terminal P2, the width of the fifth terminal P5, the width of the eighth terminal P8, the width of the eleventh terminal P11, the width of the thirteenth terminal P13, the width of the fourteenth terminal P14, the width of the fifteenth terminal P15, the width of the sixteenth terminal P16, the width of the seventeenth terminal P17, the width of the eighteenth terminal P18, and the width of the nineteenth terminal P19 are 0.24 mm, respectively. To put it simply, the width of the terminals 120 used for data transmission in this embodiment is greater than the width of the terminals 120 not used for data transmission, and the width is the size of each terminal 120 along the arrangement direction RA.

Please refer to FIG. 4 and FIG. 5 again. In this embodiment, the first terminal P1, the third terminal P3, the fourth terminal P4, the sixth terminal P6, the seventh terminal P7, the ninth terminal P9, the tenth terminal P10 and the twelfth terminal P12 each has a widening portion W1 and a contact segment C1 (here only the first terminal P1 is taken as an example). The contact segment C1 is exposed from the insulating body 110 to be in contact with the terminal of another electrical connector, and the widening portion W1 is located in the insulating body 110 (and similarly, the third terminal P3, the fourth terminal P4, the sixth terminal P6, the seventh terminal P7, the ninth terminal P9, the tenth terminal P10, and the twelfth terminal P12 each has a widening portion W1 located in the insulating body 110). Furthermore, as shown in FIG. 3 and taking the first terminal P1 as an example, the first terminal P1 can be divided into a contact segment C1 and a bending segment C2, and the bending segment C2 is equivalent to other portions of the first terminal P1 excluding the contact segment C1, thus including the portion soldered to the circuit board 200, and the widening portion W1 is located on the bending segment C2.

As shown in FIG. 3, the insulating body 110 includes a base 111 and a tongue 112 extending from the base 111. The contact segment C1 of the terminal 120 is located in the tongue 112 and exposes a portion of the tongue 112, and the widening portion W1 is located in the base 111. The tongue 112 has an upper surface S3 and a lower surface S4 opposite to each other. The ten terminals 120 in the upper row are located on the upper surface S3, and the nine terminals in the lower row are located on the lower surface S4. Here, the base 111 has a reference surface 111*a* facing the insertion direction MA, and the tongue 112 extends from the reference surface 111*a* toward the insertion direction MA, and there is a step between the tongue 112 and the base 111.

More specifically, the cross section of the base 11 of the insulating body 110 is in a zigzag shape and is divided into an upper platform 111*c* and a lower platform 111*d* with a step between each other. The cross section uses the arrangement direction RA as a normal. When the electrical connector 100 is soldered to the circuit board 200 as shown in FIG.

1, the upper platform 111*c* is located above the upper surface S1, and the lower platform 111*d* is located below the lower surface S2. Furthermore, the tongue 112 extends from the upper platform 111*c* toward the insertion direction MA, and each terminal 120 also has a soldering segment, which extends toward the positive Z-axial direction and protrudes from the surface 111*b* of the lower platform 111*d*. Here, the direction of the protrusion (positive Z-axial direction) is orthogonal to the arrangement direction RA and orthogonal to the insertion direction MA.

Figure 5:
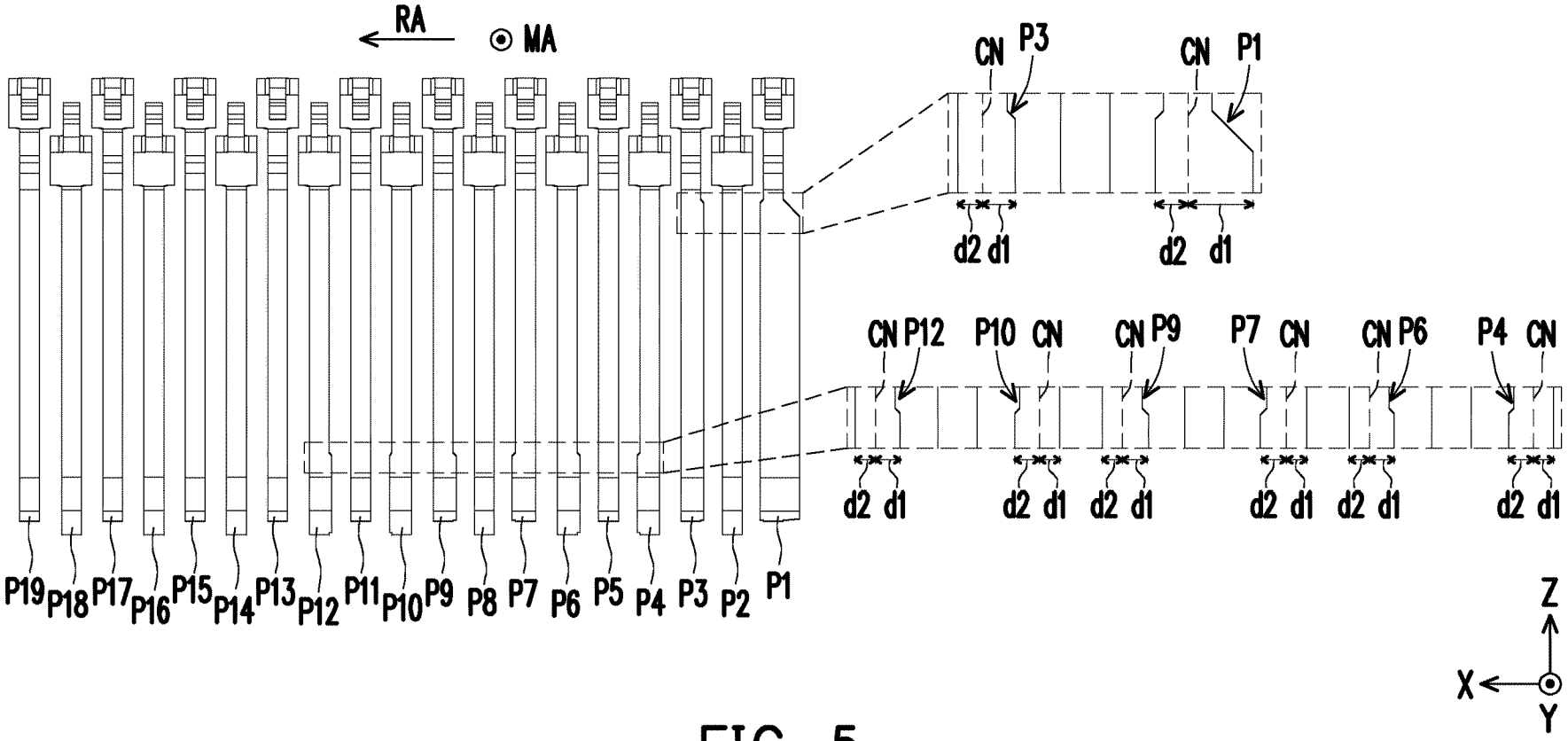
FIG. 5 shows the terminal of FIG. 4 from another perspective.

Please refer to FIG. 4 and FIG. 5 again. As mentioned above, the first terminal P1, the third terminal P3, the fourth terminal P4, the sixth terminal P6, the seventh terminal P7, the ninth terminal P9, the tenth terminal P10 and the twelfth terminal P12 each has a widening portion, and each widening portion has a different level of deviation state. As shown in FIG. 5 and referring to the table below, the widening portion of the first terminal P1, the widening portion of the third terminal P3, the widening portion of the sixth terminal P6, the widening portion of the ninth terminal P9, and the widening portion of the twelfth terminal P12 are deviated in a direction opposite to the arrangement direction RA and relative to the contact segment C1. Conversely, the widening portion of the fourth terminal P4, the widening portion of the seventh terminal P7, and the widening portion of the tenth terminal P10 are deviated relative to the contact segment C1 along the arrangement direction RA.

Here, the symmetrical centerline CN of each terminal 120 in the contact segment C1 is taken as a reference, and the widths d1 and d2 are formed as follows:

The unit of measurement for the widths d1 and d2 is mm.

| width\terminal | P1 | P3 | P4 | P6 | P7 | P9 | P10 | P12 |
|---|---|---|---|---|---|---|---|---|
| d2 | 0.16 | 0.12 | 0.15 | 0.12 | 0.16 | 0.12 | 0.15 | 0.12 |
| d1 | 0.32 | 0.16 | 0.12 | 0.15 | 0.12 | 0.16 | 0.12 | 0.15 |

Figure 6:
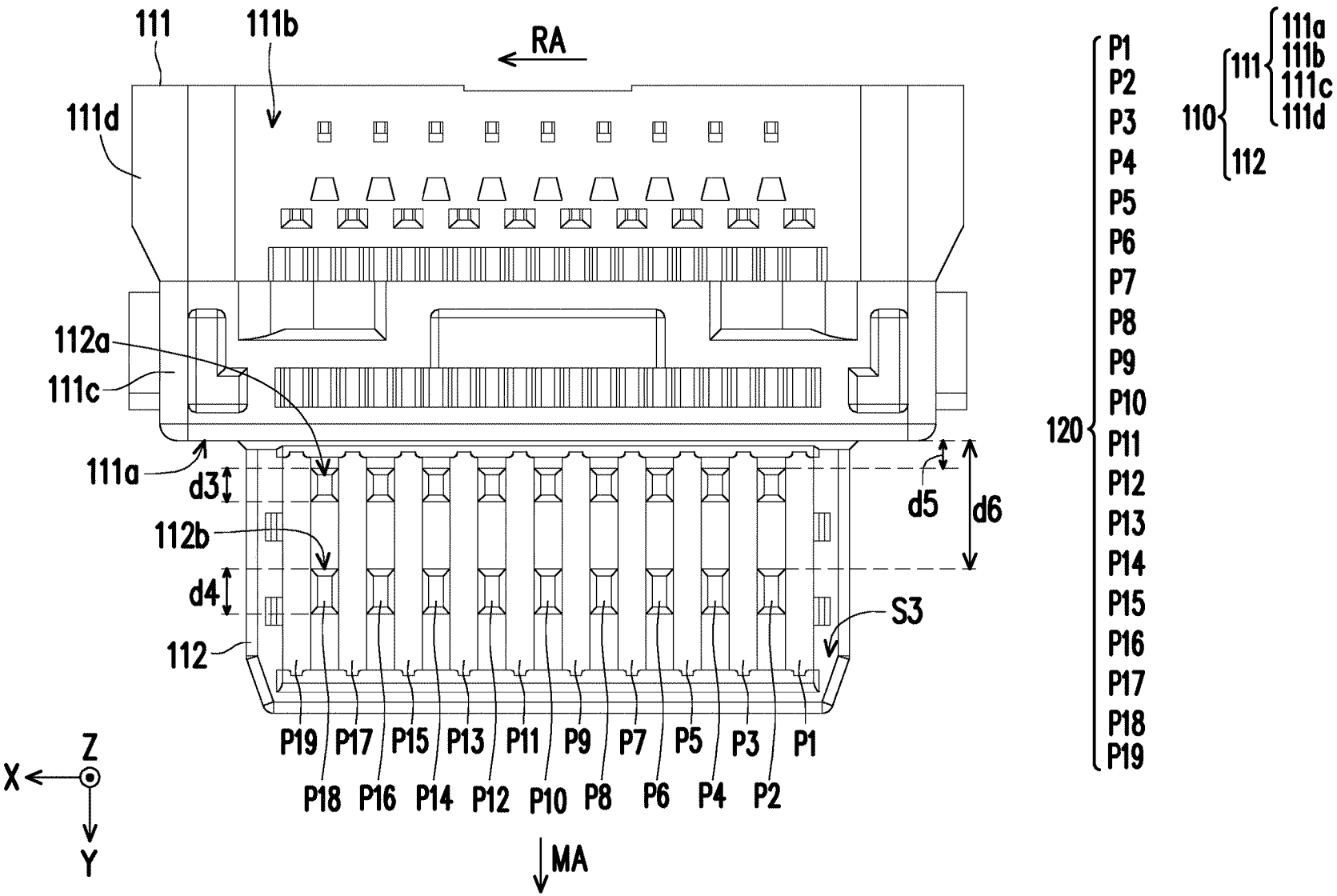
FIG. 6 and FIG. 7 respectively show some components of the electrical connector of FIG. 3 from different perspectives.
Figure 7:
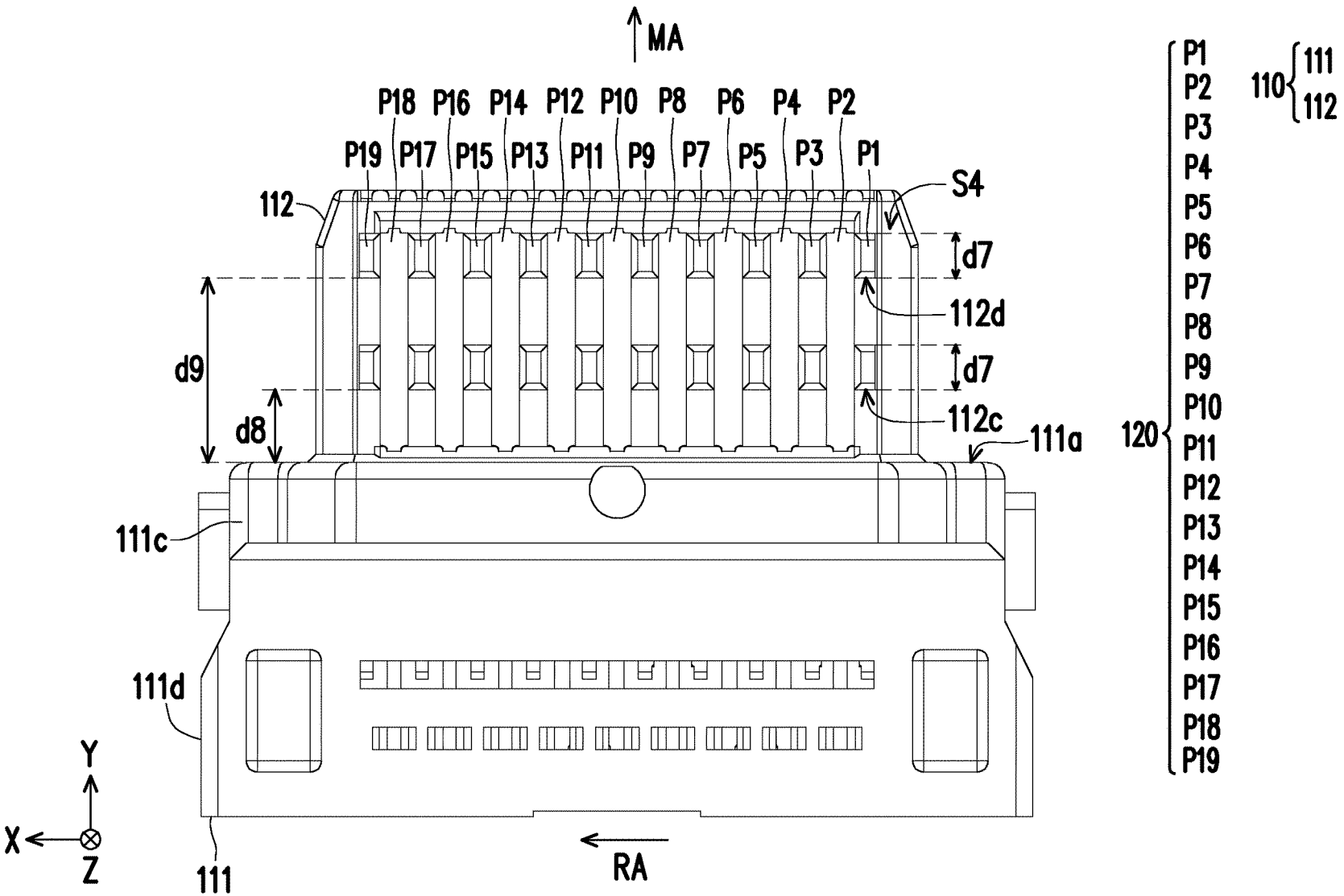

FIG. 6 and FIG. 7 respectively illustrate some components of the electrical connector of FIG. 3 from different perspectives. Please refer to FIG. 6 and FIG. 7 and compare them with FIG. 3. In this embodiment, the tongue 112 has an upper surface S3 and a lower surface S4 opposite to each other. The ten terminals in the upper row are located on the upper surface S3. The nine terminals in the lower row are located on the lower surface S4. Furthermore, the tongue 112 has a plurality of openings 112*a* and 112*b* on the upper surface S3, and a plurality of openings 112*c* and 112*d* on the lower surface S4. The openings 112*c* and 112*d* on the lower surface S4 expose portions of the ten terminals 120 in the upper row, and the openings 112*a* and 112*b* on the upper surface S3 expose portions of the nine terminals 120 in the lower row.

Furthermore, the openings 112*a* and 112*b* on the upper surface S3 are arranged in a first row and a second row along the arrangement direction RA, and the distance d5 between the first row relative to the reference surface 111*a* of the base 111 is 0.5 mm, and the distance d6 between the second row relative to the reference surface 111*a* is 2.3 mm. An opening size d3 of each opening 112*a* located in the first row is 0.6 mm along the insertion direction MA, and an opening size d4 of each opening 112*b* located in the second row is 0.8 mm along the insertion direction MA.

Furthermore, the openings 112*c* and 112*d* on the lower surface S4 are arranged in a first row and a second row along the arrangement direction RA. The distance d8 between the first row relative to the reference surface 111*a* is 1.3 mm, and the distance d9 between the second row relative to the reference surface 111*a* is 3.3 mm. An opening size d7 of each opening 112*c* located in the first row is 0.8 mm along the insertion direction MA, and an opening size d7 of each opening 112*d* located in the second row is also 0.8 mm along the insertion direction MA.

Based on the above, compared with the existing electrical connector complied with HDMI 2.0, the openings on the tongue for exposing the terminals are all 0.5 mm. In this embodiment, the openings 112*a*, 112*b*, 112*c*, and 112*d* are all enlarged, which can effectively reduce the impedance of the terminals 120, so as to meet the requirements of HDMI 2.1 for high-speed transmission.

In summary, in the above-mentioned embodiments of the disclosure, the electrical connector complied with HDMI 2.1 includes an insulating body, a plurality of terminals, and a metallic shell, and the metallic shell covers portions of the insulating body and the terminals. These terminals include ten terminals in the upper row and nine terminals in the lower row, and have specific pin assignments along the arrangement direction. Furthermore, the widths of the above-mentioned terminals along the arrangement direction are different. Among them, the first terminal, the third terminal, the fourth terminal, the sixth terminal, the seventh terminal, the ninth terminal, the tenth terminal and the twelfth terminal have a larger width. That is, these terminals with larger widths are used to transmit data, and therefore the requirements for high-frequency signal transmission can be met by increasing the width of the terminals.

What is claimed is:

1. An electrical connector complied with HDMI 2.1, comprising:

an insulating body;

a plurality of terminals, configured on the insulating body, wherein the plurality of terminals comprise ten terminals located on an upper row and nine terminals located on a lower row, and the ten terminals and the nine terminals are alternated along an arrangement direction, the ten terminals with pin assignment comprise a first terminal Data2+, a third terminal Data2−, a fifth terminal Data Shield, a seventh terminal Data0+, a ninth terminal Data0−, an eleventh terminal Data3 Shield, a thirteenth terminal CEC, a fifteenth terminal SCL, a seventeenth terminal DDC/CEC Ground, and a nineteenth terminal Hot Plug Detec1 arranged in the arrangement direction in sequence, and the nine terminals with the pin assignment comprise a second terminal Data2 Shield, a fourth terminal Data1+, a sixth terminal Data1−, an eighth terminal Data0 Shield, a tenth terminal Data3+, a twelfth terminal Data3−, a fourteenth terminal Utility, a sixteenth terminal SDA, and an eighteenth terminal +5V Power arranged in the arrangement direction in sequence; and a metallic shell, enclosing portions of the insulating body and the plurality of terminals to form an insertion space.

2. The electrical connector according to claim 1, wherein the first terminal, the third terminal, the fourth terminal, the sixth terminal, the seventh terminal, the ninth terminal, the tenth terminal, and the twelfth terminal have widths greater than widths of the second terminal, the fifth terminal, the eighth terminal, the eleventh terminal, the thirteenth terminal, the fourteenth terminal, the fifteenth terminal, the sixteenth terminal, the seventeenth terminal, the eighteenth terminal, and the nineteenth terminal.

3. The electrical connector according to claim 2, wherein the width is a size of each of the plurality of terminals in the arrangement direction.

4. The electrical connector according to claim 1, wherein the first terminal has a width of 0.46 mm to 0.51 mm, the third terminal has a width of 0.26 mm to 0.31 mm, the fourth terminal has a width of 0.25 mm to 0.30 mm, the sixth terminal has a width of 0.25 mm to 0.30 mm, the seventh terminal has a width of 0.24 mm to 0.31 mm, the ninth terminal has a width of 0.24 mm to 0.31 mm, the tenth terminal has a width of 0.26 mm to 0.30 mm, and the twelfth terminal has a width of 0.26 mm to 0.30 mm.

5. The electrical connector according to claim 1, wherein a width of the second terminal, a width of the fifth terminal, a width of the eighth terminal, a width of the eleventh terminal, a width of the thirteenth terminal, a width of the fourteenth terminal, a width of the fifteenth terminal, a width of the sixteenth terminal, a width of the seventeenth terminal, a width of the eighteenth terminal, and a width of the nineteenth terminal are 0.24 mm, respectively.

6. The electrical connector according to claim 1, wherein the first terminal, the third terminal, the fourth terminal, the sixth terminal, the seventh terminal, the ninth terminal, the tenth terminal, and the twelfth terminal each has a widening portion and a contact segment, and the contact segment is exposed from the insulating body to be in contact with a terminal of another electrical connector, and the widening portion is located in the insulating body.

7. The electrical connector according to claim 6, wherein the insulating body comprises a base and a tongue extending from the base, the contact segment is located in the tongue and exposes a portion of the tongue, and the widening portion is located in the base.

8. The electrical connector according to claim 7, wherein the tongue has an upper surface and a lower surface opposite to each other, the ten terminals in the upper row are located on the upper surface, and the nine terminals in the lower row are located on the lower surface.

9. The electrical connector according to claim 8, wherein the tongue has a plurality of openings on the upper surface and a plurality of openings on the lower surface, and the plurality of openings on the lower surface expose portions of the ten terminals in the upper row, the plurality of openings on the upper surface expose portions of the nine terminals in the lower row.

10. The electrical connector according to claim 9, adapted for connecting with another electrical connector along a insertion direction, wherein the insertion direction is orthogonal to the arrangement direction, and the tongue extends from a reference surface of the base toward the insertion direction, the plurality of openings located on the upper surface are arranged in a first row and a second row along the arrangement direction, a distance between the first row relative to the reference surface is 0.5 mm, and a distance between the second row relative to the reference surface is 2.3 mm, an opening size of each of the openings located in the first row is 0.6 mm along the insertion direction, and an opening size of each of the openings located in the second row is 0.8 mm along the insertion direction.

11. The electrical connector according to claim 9, adapted for connecting with another electrical connector along a insertion direction, wherein the insertion direction is orthogonal to the arrangement direction, and the tongue extends from a reference surface of the base toward the insertion direction, the plurality of openings located on the lower surface are arranged in a first row and a second row along the arrangement direction, a distance between the first row relative to the reference surface is 1.3 mm, and a distance between the second row relative to the reference surface is 3.3 mm, an opening size of each of the openings located in the first row is 0.8 mm along the insertion direction, and an opening size of each of the openings located in the second row is 0.8 mm along the insertion direction.

12. The electrical connector according to claim 6, wherein the widening portion of the first terminal, the widening portion of the third terminal, the widening portion of the sixth terminal, the widening portion of the ninth terminal, and the widening portion of the twelfth terminal are respectively deviated in a direction opposite to the arrangement direction relative to the contact segment.

13. The electrical connector according to claim 6, wherein the widening portion of the fourth terminal, the widening portion of the seventh terminal, and the widening portion of the tenth terminal are respectively deviated in a direction opposite to the arrangement direction relative to the contact segment.

14. The electrical connector according to claim 1, adapted for connecting with another electrical connector along a insertion direction, wherein the insertion direction is orthogonal to the arrangement direction, the insulating body comprises a base and a tongue extending from the base, a cross section of the base is in a zigzag shape and is divided into an upper platform and a lower platform with a step between each other, the cross section uses the arrangement direction as a normal, the tongue extends from the upper platform toward the insertion direction, each of the plurality of terminals has a contact segment and a soldering segment, the contact segment is located on the tongue, and the soldering segment protrudes from the lower platform, and a direction of the protrusion is orthogonal to the arrangement direction and orthogonal to the insertion direction.

15. The electrical connector according to claim 14, adapted for soldering to a circuit board, wherein the circuit board has an upper surface and a lower surface opposite to each other, the upper platform is located above the upper surface, and the lower platform is located below the lower surface.

16. The electrical connector according to claim 1, wherein the metallic shell has a long lateral edge and a short lateral edge, the ten terminals in the upper row are adjacent to the long lateral edge and away from the short lateral edge, and the nine terminals in the lower row are adjacent to the short lateral edge and away from the long lateral edge.

17. An electrical connector complied with HDMI 2.1, comprising:

an insulating body;

a plurality of terminals, configured on the insulating body, wherein the plurality of terminals comprise ten terminals located on an upper row and nine terminals located on a lower row, and the ten terminals and the nine terminals are alternated along an arrangement direction, the ten terminals with pin assignment comprise a first terminal Data2+, a third terminal Data2−, a fifth terminal Data Shield, a seventh terminal Data0+, a ninth terminal Data0−, an eleventh terminal Data3 Shield, a thirteenth terminal CEC, a fifteenth terminal SCL, a seventeenth terminal DDC/CEC Ground, and a nineteenth terminal Hot Plug Detec1 arranged in the arrangement direction in sequence, and the nine terminals with the pin assignment comprise a second terminal Data2 Shield, a fourth terminal Data1+, a sixth terminal Data1−, an eighth terminal Data0 Shield, a tenth terminal Data3+, a twelfth terminal Data3−, a fourteenth terminal Utility, a sixteenth terminal SDA, and an eighteenth terminal +5V Power arranged in the arrangement direction in sequence, wherein the first terminal has a width of 0.46 mm to 0.51 mm, the third terminal has a width of 0.26 mm to 0.31 mm, the fourth terminal has a width of 0.25 mm to 0.30 mm, the sixth terminal has a width of 0.25 mm to 0.30 mm, the seventh terminal has a width of 0.24 mm to 0.31 mm, the ninth terminal has a width of 0.24 mm to 0.31 mm, the tenth terminal has a width of 0.26 mm to 0.30 mm, and the twelfth terminal has a width of 0.26 mm to 0.30 mm; and a metallic shell, enclosing portions of the insulating body and the plurality of terminals to form an insertion space.

18. The electrical connector according to claim 17, wherein a width of the second terminal, a width of the fifth terminal, a width of the eighth terminal, a width of the eleventh terminal, a width of the thirteenth terminal, a width of the fourteenth terminal, a width of the fifteenth terminal, a width of the sixteenth terminal, a width of the seventeenth terminal, a width of the eighteenth terminal, and a width of the nineteenth terminal are 0.24 mm, respectively.

19. The electrical connector according to claim 17, wherein the width is a size of each of the plurality of terminals in the arrangement direction.

20. The electrical connector according to claim 17, wherein the first terminal, the third terminal, the fourth terminal, the sixth terminal, the seventh terminal, the ninth terminal, the tenth terminal, and the twelfth terminal each has a widening portion and a contact segment, and the contact segment is exposed from the insulating body to be in contact with a terminal of another electrical connector, and the widening portion is located in the insulating body.

21. The electrical connector according to claim 20, wherein the insulating body comprises a base and a tongue extending from the base, the contact segment is located in the tongue and exposes a portion of the tongue, and the widening portion is located in the base.

22. The electrical connector according to claim 21, wherein the tongue has an upper surface and a lower surface opposite to each other, the ten terminals in the upper row are located on the upper surface, and the nine terminals in the lower row are located on the lower surface.

23. The electrical connector according to claim 22, wherein the tongue has a plurality of openings on the upper surface and a plurality of openings on the lower surface, and the plurality of openings on the lower surface expose portions of the ten terminals in the upper row, the plurality of openings on the upper surface expose portions of the nine terminals in the lower row.

24. The electrical connector according to claim 23, adapted for connecting with another electrical connector along an insertion direction, wherein the insertion direction is orthogonal to the arrangement direction, and the tongue extends from a reference surface of the base toward the insertion direction, the plurality of openings located on the upper surface are arranged in a first row and a second row along the arrangement direction, a distance between the first row relative to the reference surface is 0.5 mm, and a distance between the second row relative to the reference surface is 2.3 mm, an opening size of each of the openings located in the first row is 0.6 mm along the insertion direction, and an opening size of each of the openings located in the second row is 0.8 mm along the insertion direction.

25. The electrical connector according to claim 23, adapted for connecting with another electrical connector along an insertion direction, wherein the insertion direction is orthogonal to the arrangement direction, and the tongue extends from a reference surface of the base toward the insertion direction, the plurality of openings located on the lower surface are arranged in a first row and a second row along the arrangement direction, a distance between the first row relative to the reference surface is 1.3 mm, and a distance between the second row relative to the reference surface is 3.3 mm, an opening size of each of the openings located in the first row is 0.8 mm along the insertion direction, and an opening size of each of the openings located in the second row is 0.8 mm along the insertion direction.

26. The electrical connector according to claim 20, wherein the widening portion of the first terminal, the widening portion of the third terminal, the widening portion of the sixth terminal, the widening portion of the ninth terminal, and the widening portion of the twelfth terminal are respectively deviated in a direction opposite to the arrangement direction relative to the contact segment.

27. The electrical connector according to claim 20, wherein the widening portion of the fourth terminal, the widening portion of the seventh terminal, and the widening portion of the tenth terminal are respectively deviated in a direction opposite to the arrangement direction relative to the contact segment.

28. The electrical connector according to claim 17, adapted for connecting with another electrical connector along a insertion direction, wherein the insertion direction is orthogonal to the arrangement direction, the insulating body comprises a base and a tongue extending from the base, a cross section of the base is in a zigzag shape and is divided into an upper platform and a lower platform with a step between each other, the cross section uses the arrangement direction as a normal, the tongue extends from the upper platform toward the insertion direction, each of the plurality of terminals has a contact segment and a soldering segment, the contact segment is located on the tongue, and the soldering segment protrudes from the lower platform, and a direction of the protrusion is orthogonal to the arrangement direction and orthogonal to the insertion direction.

29. The electrical connector according to claim 28, adapted for soldering to a circuit board, wherein the circuit board has an upper surface and a lower surface opposite to each other, the upper platform is located above the upper surface, and the lower platform is located below the lower surface.

30. The electrical connector according to claim 17, wherein the metallic shell has a long lateral edge and a short lateral edge, the ten terminals in the upper row are adjacent to the long lateral edge and away from the short lateral edge, and the nine terminals in the lower row are adjacent to the short lateral edge and away from the long lateral edge.

* * * * *